United States Patent [19]

Mori et al.

[11] Patent Number: 4,623,325

[45] Date of Patent: Nov. 18, 1986

[54] FOLDING INSERT FOR FORMING A JACKET

[75] Inventors: Yoshinobu Mori, Omihachiman; Akira Tada, Toyonaka, both of Japan

[73] Assignee: O-M Limited, Osaka, Japan

[21] Appl. No.: 557,226

[22] Filed: Nov. 30, 1983

[30] Foreign Application Priority Data

Dec. 3, 1982 [JP] Japan ..... 57-183766[U]

[51] Int. Cl.[4] ..... B31B 1/28; B31B 1/56

[52] U.S. Cl. ..... 493/468; 493/254; 493/408; 229/68 R; 206/312

[58] Field of Search ..... 206/309, 312; 229/68 R, 229/48 R; 493/254, 472, 473, 474, 475, 408, 252, 468

[56] References Cited

U.S. PATENT DOCUMENTS

| | | | |
|---|---|---|---|
| 2,058,501 | 10/1936 | Potdevin | 493/254 |
| 3,041,944 | 7/1962 | Minkow | 493/472 |
| 3,059,547 | 10/1962 | Piazze | 493/472 |
| 3,344,978 | 10/1967 | Garrod | 206/309 |
| 3,874,276 | 4/1975 | Froehlig | 493/249 |
| 4,493,682 | 1/1985 | Bryson et al. | 493/472 |
| 4,559,030 | 12/1985 | Tada et al. | 493/254 |

*Primary Examiner*—George E. Lowrance
*Assistant Examiner*—Brenda J. Ehrhardt
*Attorney, Agent, or Firm*—Wenderoth, Lind & Ponack

[57] ABSTRACT

A folding insert for forming a jacket to be used for a device to form a envelope-shape jacket for a magnetic cartridge. The folding insert is provided with protrusions and grooves along both side edges thereof, whereby flaps of the jacket material can be bent more than 180° by a folding bar along the protrusions of the folding insert.

3 Claims, 5 Drawing Figures

FOLDING INSERT FOR FORMING A JACKET

BACKGROUND OF THE INVENTION

1. Field of the Invention

This invention relates to a folding insert which is used in forming an envelope-like jacket for a magnetic cartridge.

2. Description of the Prior Art

In recent years, a magnetic cartridge with a magnetic disk on which voice signals, video signals, data signals, etc. are recorded has been enclosed in an envelope-shaped jacket during storage and use. A magnetic cartridge of this type is inserted in a floppy disk device of a computer while the magnetic disk is enclosed in a jacket and the recorded information is reproduced by rotating the magnetic disk and by causing a reproduction head to contact a track thereon. Such a magnetic cartridge is described below with reference to FIG. 1.

A magnetic cartridge 1 comprises a magnetic disk 2 and a jacket 5 in which the magnetic disk is enclosed. The magnetic disk 2 is made of film having moderate flexibility, such as polyester resin, and is cut in the desired circular shape and an engaging hole 3 is provided at the center thereof. Various signals are recorded on a track 4 constituted by a magnetic layer coated on both surfaces thereof. The jacket 5 is made of thermosetting resin, such as vinyl chloride, and is a substantially square-envelope. A circular opening 6 slightly larger than the engaging hole 3 is bored at the central part of the jacket 5. A detecting hole 7 for the point of the start of reproduction and a slot 8 through which a reproduction head makes contact with the track 4 are provided on opposite sides of the circular opening 6. A ruled piece of paper 9 is stuck to the upper corner of the jacket. As shown in FIG. 2, the jacket is made of a rectangular sheet of material 10 which is folded in two. This jacket material 10 is covered with a nonwoven liner 11 over almost all the surface of the one side which becomes the inside of the jacket. The circular opening 6, the detecting hole 7 and the slot 8 are provided at the designated positions of the right half portion 12 and the left half portion 13. Flaps 14, 15 and 16 of small width are provided at the three sides of the left half portion 13.

This jacket material is fed onto a table of a jacket forming device (to be described later). The left half portion 13 of the jacket material is pressed by a folding insert (to be described later) and a folding bar (not shown in the drawings) is placed in tight contact with the underside of a center line 17 of the jacket material. By the revolution of the folding bar, the right half portion 12 is bent 180° and is placed upon the folding insert. A heater bar (not shown in the drawings) is applied to the folded corner to form it in a sideward facing U shape. Then, flaps 14, and 15 at the two sides of the left half portion are bent 180° by another folding bar, while the folding insert is still on the jacket material, and are placed on the side edges of the right half portion and the folded corners of the flaps are formed in a sideward facing U shape by another heater bar. Two portions 18 at both end portions of each flap are fused by ultrasonic waves or the like and the jacket material is pulled off the folding insert. Next, the ruled paper 9 is stuck to an upper corner of the left half portion 13 which becomes the front side and thus an envelope-shape jacket having a fixed opening is produced. The magnetic disk 2 is inserted in this jacket, the flap 16 is bent 180°, the folded corner is heated by the heater bar for formation of a sideward facing U shape and finally two portions 19 at both end portions of the flap 16 are fused. Thus, the magnetic cartridge is finished. It is possible to punch the circular opening 6, the detecting hole 7 and the slot 8 on both portions after the jacket 5 has been produced.

Since this magnetic cartridge is inserted in a floppy disk device of a computer with the magnetic disk 2 enclosed in the jacket 5, it has such advantages that the magnetic layer of the magnetic disk is free from being coated with dust and is kept clean by the liner 11 while the magnetic disk is turning. On the contrary, however, high precision is required for the external form and dimensions of the jacket.

Conventionally, a folding insert which is a simple flat plate is used for forming the jacket but such a folding insert cannot bend the flap of jacket material more than 180° and therefore when a bent flap is fused at two portions, its intermediate portion is liable to rise, with resultant formation of a gap, or the back surface of a jacket is raised due to flyback of the flap, causing swelling at its inner part. Such jackets which have a poor external shape and dimensions are difficult to insert in a floppy disk device. Even if the jacket is inserted, the magnetic disk will not rotate smoothly and consequently reproduction of the recorded material will be inaccurate and cleaning of the magnetic coating by the liner cannot be achieved.

SUMMARY OF THE INVENTION

According to the present invention, a protrusion or both a protrusion and a groove are provided along the edge of both sides of a folding insert for jacket forming so that the flaps of jacket material can be folded more than 180° along the protrusion, thereby eliminating such troubles as rising of the flap at the intermediate part and swelling at the inner part of the back surface of a jacket and ensuring formation of a jacket of high precision in external shape and dimensions.

An embodiment of the folding insert according to the present invention is described below with reference to the accompanying drawings.

IN THE DRAWINGS

DESCRIPTION OF THE PREFERRED EMBODIMENT

Figure 1:
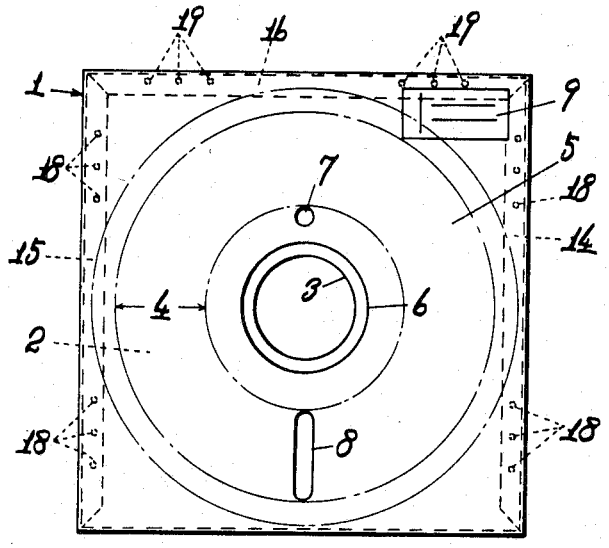
Fig. 1 (PRIOR ART)
FIG. 1 is a plan view of the magnetic cartridge.
Figure 2:
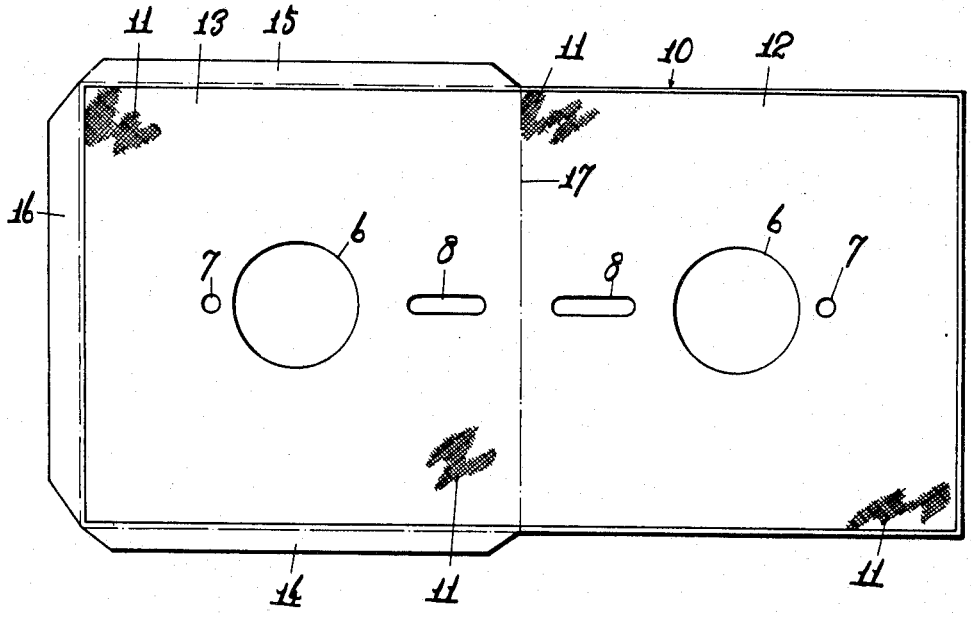
Fig. 2 (PRIOR ART)
FIG. 2 is a front view of the jacket material prior to folding.
Figure 3:
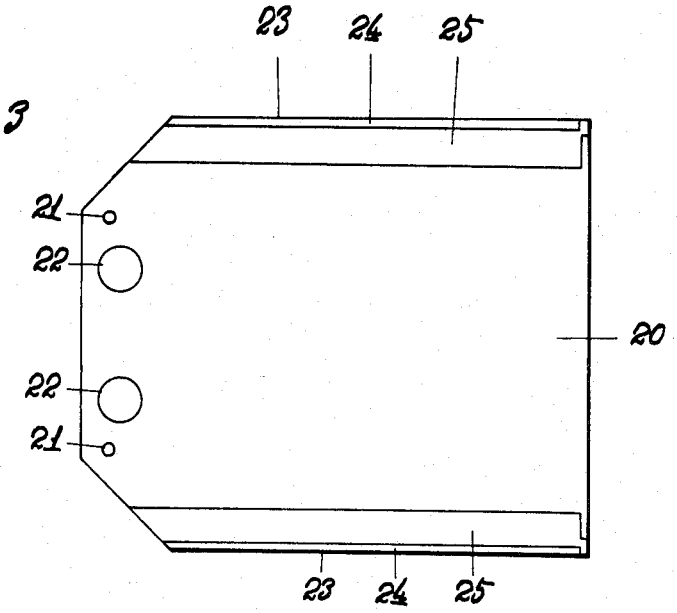
FIG. 3 is a plan view of an embodiment of a folding insert according to the invention.
Figure 4:
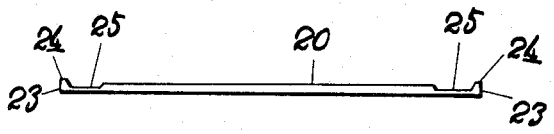
FIG. 4 is an end view thereof as seen from the right side of FIG. 3.
Figure 5:
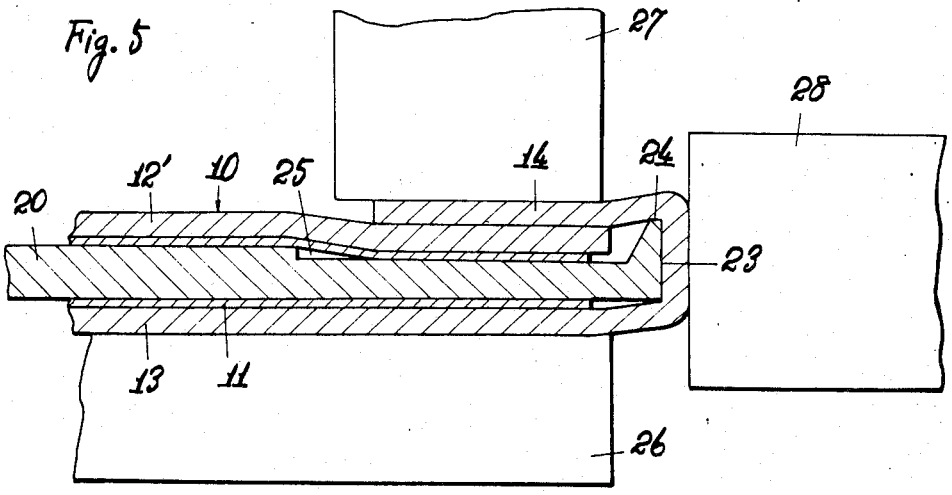
FIG. 5 is a sectional view of the right end portion of the insert as shown in FIG. 4, on an enlarged scale and with the jacket material folded therearound.

In the embodiment shown in FIG. 3–FIG. 5, numeral 20 designates a folding insert to be placed on a table 26 of a jacket forming device. Two small holes 21 are provided at the left end portion which has both corners diagonally leveled and fitted to a rocking arm (not shown in the drawings) and stop pins (not shown in the drawings) which are at the extreme end of the table surface are inserted in the small holes 21. Small projections 23 are provided along both side edges of the folding insert 20 and shallow grooves 25 are provided in the insert just inside of the projections. The projection 23 is trapezoidal in cross section as shown in FIG. 5 and its top edge 24 is slightly higher than the level of the upper surface of the folding insert 20. The groove 25 is made by scraping the upper surface of the folding insert 20 at fixed breadth and to a fixed depth. The fixed breadth is such that the folded flap 14 can fit within the groove.

One embodiment of the present invention is composed as described above. The folding insert rocks vertically through a small angle and at the designated time by means of the rocking arm and when the folding insert rises off the table 26, a jacket material is supplied from the right side and abuts the stop pin. Immediately after this, the folding insert 20 is lowered and presses the left half portion 13 of the jacket material against the table 26. Then, a folding bar for folding the jacket is brought into tight contact with the underside of the center line of the jacket material and the right half portion 12 of the jacket material is folded 180° by the revolution of the folding bar onto the folding insert 20. This folded corner is formed in a sideward facing U shape by applying a heater bar to the folded edge and thus the first stage of the process ends. Next, the table 26 is revolved 90° to transfer it to the second stage of the process, where the flap 14 is folded more than 180° around projection 23, with the folding insert 20 still on the jacket material, by a folding bar 27 and is placed against the side edge 12' of the right half portion 12. After applying a flap heater bar 28 to this folded corner for formation of the sideward facing U shape, two portions at the two end portions of the flap 14 are fused by ultrasonic waves. The flap 15 of the jacket material is also bent and formed in a sideward facing U shape at the same time by means of a folding bar and a heater bar on the opposite side of the table 26 (neither shown in the drawings).

Since the conventional folding insert is a simple flat plate, the maximum angle that the flap 14 can be bent by means of the folding bar 27 is 180°. Generally, the thermoplastic resin sheet has a property such that it generates some flyback due to its own elasticity. Therefore, the flap 14 which cannot be bent beyond 180° will return to a bent angle of less than 180° due to flyback. Since two portions of the flap are fused, its intermediate portion will rise or the back surface of the jacket will swell at its inner part. Conventionally, because the flaps are bent as much as 180°, the heater bar 28 is applied for a comparatively long time and as a result, a long time is required to cool the flaps.

In the present invention, because the trapezoidal shape cross section projections 23 and shallow grooves 25 on the inner side of the protrusions are provided along the both side edges of the folding insert 20, the folding bar 27 causes the flap 14 to move downwardly into the groove 25 along the protrusion 23 as shown in FIG. 5, namely, the folding bar 27 can bend the flap 14 more than 180°. Therefore, when the folding bar 27 and the heater bar 28 are separated from the jacket material, the flap 14 returns slightly, due to flyback, to a bent angle of 180° and thus the folded corner is formed exactly in a sideward facing U shape.

In the present embodiment, the height of the projection is so selected that the bent angle after formation of the flap becomes 180°. This height of the protrusion is related to the amount of flyback of the jacket material. If the amount of flyback is large, the flap must be bent more than 180° and accordingly the height of the projections 23 must be made very high. However, projections which are too high do not conform to the standards of a jacket. In this connection, it is suggested to provide the shallow groove 25 at the inner side of the projection 23, whereby the top edge 24 of the projection can be on the same level with or only slightly higher than the upper surface of the folding insert 20. However, in the case where a jacket material having a small amount of flyback, the projection 23 need not be so high and therefore the groove 25 need not be provided.

As described above, in the present embodiment the flap 14 is bent more than 180° depending on the amount of the flyback of the jacket material, whereby the bent angle of the flap 14 after formation becomes 180°. Therefore, when two portions of the folded flap are fused, there are no such troubles as rising of the intermediate portion of the flap and swelling of the inner part of the back surface of the jacket. Since the present embodiment takes into account the flyback of the flap, the time during which a heater bar is applied can be shortened and accordingly the time to cool can also be shortened, with resultant shortening of the processing time as a whole. Also, production of inferior finished goods having scratches, waving, etc. can be eliminated.

The present invention is not limited to the above embodiment but can be changed in design within the scope of the gist of the present invention. For example, the projection 23 can have a shape other than the trapezoidal shape in cross section and the groove 25 can be dispensed with, depending upon the quality of the jacket material.

According to the present invention, since projections or both projections and grooves are provided at both side edges of the folding insert and the flaps are bent more than 180° along the projections, the bent angle of the flap after formation becomes 180° with the flyback of the flap and accordingly fusing of the flap involves neither rising of the intermediate portion of the flap nor swelling at the inner part of the back surface of the jacket. Also, the total time required for processing can be shortened and such trouble as scratching and waving can be prevented. Thus, the present invention is good for producing jackets with a high precision of the external shape and dimensions with high efficiency.

What is claimed is:

1. A folding insert for forming a substantially square envelope-shaped jacket for holding a magnetic disk to form a flexible disk cartridge, the jacket being formed by folding a rectangular sheet of thermoplastic resin material substantially in half with one portion on top of the other, the lower portion having flaps along the side edges which are then folded around the folding insert and adhered to the folded over upper portion of the rectangular sheet, said folding insert comprising:

a flat plate having substantially the same width as the width of the rectangular sheet;

projection means extending along both side edges of said flat plate around which the flaps are to be folded and which project slightly above the plane of the upper surface of said flat plate;

whereby the flaps of the rectangular sheet can be bent more than 180° around said projection means so that upon flyback of the flaps, they will be positioned substantially 180° from the plane of the lower portion from which they were folded.

2. A folding insert as claimed in claim 1 in which said projection means consists of a projection.

3. A folding means as claimed in claim 1 in which said projection means comprises a projection, and said plate having a groove therein extending along the inside of said projection.

* * * * *